United States Patent [19]

Iwakura et al.

[11] Patent Number: 4,520,377

[45] Date of Patent: May 28, 1985

[54] HEAT-SENSITIVE RECORDING MATERIALS

[75] Inventors: Ken Iwakura, Kanagawa; Akira Igarashi, Shizuoka, both of Japan

[73] Assignee: Fuji Photo Film Co., Ltd., Kanagawa, Japan

[21] Appl. No.: 539,901

[22] Filed: Oct. 7, 1983

[30] Foreign Application Priority Data

Oct. 7, 1982 [JP] Japan ..... 57-176747

[51] Int. Cl.[3] ..... B41M 5/18

[52] U.S. Cl. ..... 346/208; 346/209; 427/150; 427/151

[58] Field of Search ..... 282/27.5; 427/150–153; 428/320.4–320.8, 411, 488, 537, 913, 914; 346/200, 208, 209, 225

[56] References Cited

FOREIGN PATENT DOCUMENTS

| | | | |
|---|---|---|---|
| 0009834 | 1/1980 | Japan | 346/200 |
| 0010490 | 2/1981 | Japan | 346/209 |
| 0203591 | 12/1982 | Japan | 346/216 |
| 2092767A | 8/1982 | United Kingdom | 346/209 |

*Primary Examiner*—Bruce H. Hess

*Attorney, Agent, or Firm*—Sughrue, Mion, Zinn, Macpeak & Seas

[57] ABSTRACT

A heat-sensitive recording material is disclosed. The material is comprised of a support base having a color forming layer positioned thereon. The layer is comprised of an electron donating colorless dye, an electron accepting compound, a naphthol derivative, and a urea derivative and/or a urethane derivative. The recording material can provide good color density and color sensitivity.

18 Claims, No Drawings

HEAT-SENSITIVE RECORDING MATERIALS

FIELD OF THE INVENTION

The present invention relates to heat-sensitive recording materials and, particularly, to heat-sensitive recording materials having an improved color forming property.

BACKGROUND OF THE INVENTION

Heat-sensitive recording materials using an electron donating colorless dye (color former) and an electron accepting compound (color developer) have been disclosed in Japanese Patent Publications No. 14039/70 (corresponding to U.S. Pat. No. 3,539,375) and No. 4160/68 (corresponding to U.S. patent application Ser. No. 512,546). Properties which are essentially required for the heat-sensitive recording materials are that (1) color density and color sensitivity must be sufficient, (2) fogging (a color formation phenomenon during preservation before using) is not caused, and (3) a colored product after color formation has sufficient fastness. However, heat-sensitive recording materials which completely satisfy these requirements have not been obtained up to now.

Particularly, studies relating to the above described requirement (1) have recently been earnestly carried out on means for speeding up of the heat-sensitive recording system.

One of the methods is to elevate the melting point of the electron accepting compound from 60° C. to 100° C. However, in phenol compounds which are most widely used at present as electron accepting compounds, it is difficult to control the melting point. Further, since the phenolic compounds are expensive, their practically is inferior.

Another method described in Japanese Patent Publications Nos. 17748/74 and 39567/76 uses an organic acid and a phenolic compound together as the electron accepting substances or a polyvalent metal salt of compounds having an alcoholic hydroxyl group. Further, it has been described in Japanese Patent Publication No. 29945/76 to use copolymers of hydroxyethyl cellulose and maleic acid anhydride salt.

Further, the addition of waxes has been described in Japanese Patent Publication No. 27599/76 and Japanese Patent Application (OPI) No. 19231/73 (The term "OPI" as used herein refers to a "published unexamined Japanese patent application". ).

Additional approaches have been described in Japanese Patent Applications (OPI) Nos. 34842/74, 115554/74, 149353/75, 106746/77, 5636/78, 11036/78, 48751/78 and 72996/81. These approaches involve adding nitrogen containing organic compounds such as thioacetanilide, phthalonitrile, acetamide, di-$\beta$-naphthyl-p-phenylenediamine, aliphatic acid amide, acetoacetanilide, diphenylamine, benzamide or carbazole, etc., thermofusible substances such as 2,3-di-m-tolylbutane or 4,4'-dimethylbiphenyl, etc., or carboxylic acid esters such as dimethyl isophthalate, diphenyl phthalate or dimethyl terephthalate, etc., as a sensitizer. Furthermore, it has been described in British Patent Publication No. 2,074,335A to add hindered phenols.

However, heat-sensitive recording materials produced by using these methods are insufficient with respect to color density and color sensitivity.

SUMMARY OF THE INVENTION

Accordingly, an object of the present invention is to provide heat-sensitive recording materials in which the color density and the color sensitivity are sufficient and other requirements, e.g., the fastness of the colored product, the whiteness of background and the properties of preventing the fogging and sticking, are satisfied.

The objects of the present invention are attained with heat-sensitive recording materials which comprise (A) an electron donating colorless dye, (B) an electron accepting compound, (C) a naphthol derivative and (D) a urea derivative and/or a urethane derivative.

DETAILED DESCRIPTION OF THE INVENTION

Preferred urea derivatives and/or the urethane derivatives according to the present invention are urea derivatives having 7 or more carbon atoms and/or urethane derivatives having 8 or more carbon atoms. In the urea derivatives having 7 or more carbon atoms, compounds represented by the following general formfula (I) are particularly preferred.

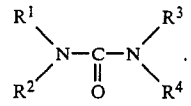

(I)

In the formula (I), $R^1$, $R^2$, $R^3$ and $R^4$ may be identical or different, and each represents a hydrogen atom, a substituted or unsubstituted alkyl group or a substituted or unsubstituted aryl group, and, further, $R^4$ represents

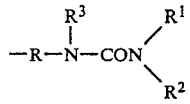

(wherein R represents an alkylene group, an arylene group, an aralkylene group or an oxyalkylene group, and $R^1$, $R^2$ and $R^3$ are the same as described above. However, in the above described general formula (I), the sum of carbon atom numbers in the substituents represented by $R^1$, $R^2$, $R^3$ and $R^4$ is 6 or mre.

In the above described general formula (I), the alkyl groups represented by $R^1$, $R^2$, $R^3$ and $R^4$ preferably have 1 to 18 carbon atoms. Preferred alkyl groups having substituents are those substituted by an alkoxy group having a total of 3 to 12 carbon atoms and those substituted by an aryloxy group having a total of 7 to 21 carbon atoms. Further, the aryl groups may have substituents, which preferably have 6 to 28 carbon atoms, e.g., halogens, alkoxy, alkyl, aralkyl, cyano and nitro groups.

Further, in the urethane derivatives having 8 or more carbon atoms, compounds represented by the following general formulas (II), (III) and (IV) are particularly preferred.

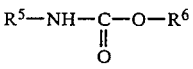

(II)

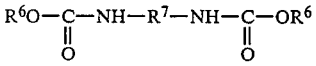

(III)

-continued $$R^5-NH-\underset{\underset{O}{\|}}{C}-O-R^8-O-\underset{\underset{O}{\|}}{C}-NH-R^5 \quad (IV)$$

In the formulae (II–IV), $R^5$ and $R^6$ each represent a substituted or unsubstituted alkyl group or a substituted or unsubstituted aryl group, $R^7$ represents an alkylene group, an arylene group, an aralkylene group or an oxyalkylene group, and $R^8$ represents an alkylene group or an oxyalkylene group.

In the above described general formulae, the alkyl groups represented by $R^5$ and $R^6$ preferably have 1 to 18 carbon atoms. Preferred alkyl groups having substituents are those substituted by an aryl group, an alkoxy group or an aryloxy group having a total of 7 to 21 carbon atoms. The aryl group represented by $R^6$ preferably has 6 to 28 carbon atoms.

In the above described urea derivatives and urethane derivatives, those having a melting point of 40° C. to 200° C., are preferred, more preferably 70° C. to 150° C.

Preferred naphthol derivatives according to the present invention are represented by the following general formula (V).

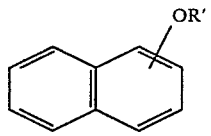

(V)

In the above formula (V), R' represents an alkyl group, an aralkyl group, an aryl group, an alkylcarbonyl group, an arylcarbonyl group, an aryloxyalkylcarbonyl group, an alkylsulfonyl group or an arylsulfonyl group.

In the above described general formula (V), the naphthalene ring may have other substituents. Preferred examples of these substituents include alkyl groups, aralkyl groups, halogen atoms, hydroxyl group, alkoxy groups, aryloxy groups, alkylcarbonyloxy groups, arylcarbonyloxy groups, alkoxycarbonyl groups, aryloxycarbonyl groups, carbamoyl groups and sulfamoyl groups, etc.

The substituent represented by R' in the above described general formula (V) may have other substituents such as alkyl groups, alkoxy groups, aryloxy groups, cyano group, nitro group, halogen atoms, alkoxycarbonyl groups, aryloxycarbonyl groups, alkylcarbonyloxy groups, arylcarbonyloxy groups, alkylsulfonyloxy groups, arylsulfonyloxy groups, carbamoyl groups, sulfamoyl groups, alkylamino groups, dialkylamino groups, acylamino groups, alkylsulfonylamino groups, arylsulfonylamino groups, alkylsulfonyl groups, arylsulfonyl groups, alkylcarbonyl groups or arylcarbonyl groups, etc.

Preferred examples of the substituent represented by R' in the above described general formula (V) include alkyl groups having 4 to 20 carbon atoms, more preferably 4 to 12 carbon atoms, aralkyl groups having 7 to 24 carbon atoms, more preferably 7 to 12, alkylcarbonyl groups having 2 to 20 carbon atoms, more preferably 4 to 14, and arylcarbonyl groups having 7 to 20 carbon atoms, more preferably 7 to 12.

Preferred substituents on the naphthalene ring in the above described general formula (V) include halogen atoms, alkyl groups having 1 to 10 carbon atoms, alkyloxycarbonyl groups having 2 to 20 carbon atoms, aryloxycarbonyl groups having 7 to 20 carbon atoms and substituted carbamoyl groups having 2 to 25 carbon atoms.

Naphthol derivatives preferably having a melting point of about 40° C. to about 150° C., more preferably 50° C. to 120° C.

The heat-sensitive recording materials containing the urea derivative and/or the urethane derivative represented by the general formulae (I) to (IV) and the naphthol derivative represented by the general formula (V) according to the present invention are sufficient in color density and color sensitivity. Further, the use of these derivatives results in less deterioration of color sensitivity over the passage of time and less fogging, and the colored products after color formation have sufficient fastness.

Heat-sensitive recording materials containing a urea derivative having a long chain akyl group of 12 to 20 carbon atoms and a naphthol derivative having an aralkyl group of 7 to 20 carbon atoms are particularly preferred.

In the following, examples of the urea derivatives according to the present invention are described.

1-Phenylurea, 1-methyl-3-phenylurea, 1-ethyl-3-phenylurea, 1,1-diethyl-3-phenylurea, 1-phenyl-3-propylurea, 3-phenyl-1,1-dipropylurea, 1-isopropyl-3-phenylurea, 1-isopropyl-3-phenyl-1-propylurea, 1,1-diisopropyl-3-phenylurea, 1-butyl-3-phenylurea, 1,1-dibutyl-3-phenylurea, 1-isobutyl-3-phenylurea, 1-tertiary butyl-3-phenylurea, 1-tertiary butyl-1-methyl-3-phenylurea, 1-pentyl-3-phenylurea, 1,1-dipentyl-3-phenylurea, 1-tertiary pentyl-3-phenylurea, 1-isopentyl-3-phenylurea, 1-phenyl-3-(1,2,2-trimethylpropyl)urea, 1-(1-ethyl-3-methylbutyl)-3-phenylurea, 1-(1-ethyl-2,2-dimethylbutyl)-3-phenylurea, 1-phenyl-3-(1,1,3,3-tetramethylbutyl)urea, 1-decyl-3-phenylurea, 1-(1-butylhexyl)-3-phenylurea, 1-(1-butyl-1-ethylpentyl)-3-phenylurea, 1-dodecyl-3-phenylurea, 1-octadecyl-3-phenylurea, 1-cyclohexyl-3-phenylurea, 1,1-dicyclohexyl-3-phenylurea, 1-(3-methoxypropyl)-3-phenylurea, 1-(3-cyclohexylpropyl)-3-phenylurea, 1-(p-methoxyphenyl)-3-butylureide, 1-(2-phenoxyethyl)-3-phenylurea, 1-benzyl-3-phenylurea, 1-(4-octadecyloxyphenyl)-3-phenylurea, 1-octadecylurea, 1-dodecyl-3-butylurea, 1-benzyl-3-butylurea, 1,1-diisobutyl-3-(1-naphthyl)urea, 1,3-dioctadecylurea, 1,1-dimethyl-3-(2,4-xylyl)urea, 4,4'-bis(3-butylureido)diphenylmethane, 2,4-bis(3-(2-butoxyethyl)ureido)toluene, 1,6-bis(3-benzylureido)hexane, 1-hexadecylurea and 1,3-didodecylurea.

In the following, examples of the urethane derivatives are described.

Phenylcarbamoyloxydodecane, phenylcarbamoyloxyoctadecane, phenylcarbamoyloxymethylbenzene, octadecylcarbamoyloxymethylbenzene, 5-methyl-1-(phenylcarbamoyloxy)hexane, 1,4-bis(phenylcarbamoyloxymethyl)benzene, bis-(2-phenylcarbamoyloxyethyl)ether, 1,3-bis-(phenylcarbamoyloxy)propane, 1-phenoxy-5-(phenylcarbamoyloxy)pentane, 1,6-bis-(phenylcarbamoyloxy)heptane, 1,2-bis-(phenylcarbamoyloxy)cyclohexane, 4,4'-bis-(ethoxycarbonylamino)diphenylmethane, 4,4'-bis(isopropoxycarbonylamino)diphenylmethane, 4,4'-bis(benzyloxycarbonylamino)diphenylmethane, 4,4'-bis(dodecyloxycarbonylamino)diphenylmethane, 2,4-bis(dodecyloxycarbonylamino toluene, 1-(2-phenoxyethoxycarbonylamino)naphthalene, 1,5-bis(2-butoxyethoxycarbonylamino)naphthalene, 1,4-bis(ethoxycarbonylaminomethyl)benzene, 1,6-bis(hexadecyloxycarbonylamino)heptane and 3,3'-bis(octadecyloxycarbonylamino)dipropyl ether.

In the following, examples of the naphthol derivatives are described. 1-Benzyloxynaphthalene, 2-benzyloxynaphthalene, 2-p-chlorobenzyloxynaphthalene, 2-p-isopropylbenzyloxynaphthalene, 2-benzoyloxynaphthalene, 2-phenoxyacetyloxynaphthalene, 2-(3-phenoxypropionyloxy)naphthalene, and 1-p-chlorobenzyloxynaphthalene, etc. However, the present invention is not limited to them.

Examples of the electron donating colorless dye used in the present invention include triarylmethane compounds, diphenylmethane compounds, xanthene compounds, thiazine compounds and spiropyran compounds. Triarylmethane compounds and xanthene compounds are more preferred. Specific examples of them are as follows. Useful triarylmethane compounds include 3,3-bis(p-dimethylaminophenyl)-6-dimethylaminophthalide (namely, Crystal Violet lactone), 3,3-bis-(p-dimethylaminophenyl)phthalide, 3-(p-dimethylaminophenyl)-3-(1,3-dimethylindol-3-yl)phthalide and 3-(p-dimethylaminophenyl)-3-(2-methylindol-3-yl)phthalide. Useful diphenylmethane compounds include 4,4'-bis-dimethylaminobenzohydrinbenzyl ether, N-halophenyl leuco Auramine and N-2,4,5-trichlorophenyl leuco Auramine. Useful xanthene compounds include Rhodamine-B-anilinolactam, Rhodamine (p-nitroanilino)lactam, Rhodimine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran and 2-phenyl-6-diethylaminofluoran. Useful thiazine compounds include benzoyl leuco Methylene Blue, and p-nitrobenzyl leuco Methylene Blue. Useful spiro compounds include 3-methyl-spirodinaphthopyran, 3-ethyl-spiro-dinaphthopyran, 3,3'-dichloro-spirodinaphthopyran, 3-benzyl-spiro-dinaphthopyran, 3-methyl-naphtho-(3-methoxybenzo)spiropyran and 3-propyl-spiro-dibenzopyran. Any of the above referred to compounds may be used alone or in combination with one another.

Examples of useful electron accepting compound include phenol compounds, organic acid and metal salts thereof, and oxybenzoic acid esters, etc. Particularly, phenol compounds are advantageously used, because they are used in a small amounts as described in detail in Japanese Patent Publications Nos. 14039/70 and 29830/76, and U.S. Pat. Nos. 3,244,549 and 3,244,550. Examples of them include 4-tertiary butylphenol, 4-phenylphenol, 4-hydroxydiphenoxide, $\alpha$-naphthol, $\beta$-naphthol, methyl 4-hydroxybenzoate, 2,2'-dihydroxybiphenyl, 2,2-bis(4-hydroxyphenyl)propane (bisphenol A), 4,4'-isopropylidene-bis(2-methylphenol), 1,1-bis(4-hydroxyphenyl)cyclohexane, 1,1-bis(3-chloro-4-hydroxyphenyl)cyclohexane, 1,1-bis-(3-chloro-4-hydroxyphenyl)-2-ethylbutane, 4,4'-secondary isobutylidenediphenol, 4-hydroxybenzoic acid benzyl ester, 4-hydroxybenzoic acid m-chlorobenzyl ester and 4-hydroxybenzoic acid $\beta$-phenethyl ester. Of the examples, 2,2-bis-(4-hydroxyphenyl)propane(bisphenol A) and 1,1-bis(4-hydroxyphenyl)cyclohexane are most preferred.

The heat-sensitive recording materials according to the present invention contain one or more of urea derivatives and/or urethane derivatives represented by the above described general formulae (I) to (IV) and one or more of naphthol derivatives represented by the general formula (V).

The urea derivatives, the urethane derivatives and the naphthol derivatives used in the present invention are dispersed in a dispersion medium by means of a ball mill or the like so as to result in a particle size of 10 $\mu$ or less. Alternatively, they may be added simultaneously when dispersing the electron donating colorless dye and/or the electron accepting compound in a dispersion medium by means of a ball mill or the like. Particularly, since the urea derivatives and urethane derivatives are added in order to increase the sensitivity by utilizing an eutectic effect with phenols as the electron accepting compounds, it is preferred to disperse them by a ball mill after each of them are previously blended by melting with heat and powdered or to disperse them by a method described in Japanese Patent Application No. 110942/80. The latter method is particularly preferred in the viewpoint of working properties and improvement of characteristics. In carrying out the operation, the naphthol derivatives may be added at the same time.

The electron donating colorless dye and the electron accepting compound in the present invention are dispersed by powdering in a dispersion medium so as to result in a particle size of 10 $\mu$ or less, preferably 3 $\mu$ or less. As the dispersion medium, an aqueous solution of water soluble high polymers having a concentration of 1 to 10 wt % or so, preferably 2 to 8 wt %, is generally used. Preferred examples of high polymer include a polyvinyl alcohol (PVA), a methyl cellulose, a hydroxyethyl cellulose, an acryl amide series copolymer and a latex. Of the above high polymers, the polyvinyl alcohol is most preferably used. The molecular weight of the polyvinyl alcohol ranges from 1,000 to 20,000, preferably 1,500 to 10,000. The dispersing is carried out by means of a ball mill, a sand mill, an attritor or a colloid mill, etc.

The electron donating colorless dye and the electron accepting compound are used in a ratio by weight of 1:10 to 1:1, preferably, 1:5 to 2:3. Further, the urea derivatives and/or the urethane derivatives are added in a ratio by weight of 20% to 300%, preferably 50% to 150% with respect to the electron accepting compound. Further, the naphthol derivatives are added in a ratio by weight of 20% to 300%, preferably 40% to 150%, with respect to the electron accepting compound.

If the amount of the urea derivatives or urethane derivatives, or the total amount thereof or the amount of the naphthol derivatives is less than 20%, the effect of improving sensitivity which is the object of the present invention is not sufficient. If they are added in the amount of more than 300%, the sensitivity deteriorates somewhat because the thermal capacity of the system increases.

To the resulting heat-sensitive coating solution, additives are added in order to satisfy various requirements, e.g., the fastness of the colored product, the whiteness of background and the properties of preventing the fogging and sticking as well as color density and color sensitivity.

For example, oil absorbing substances such as inorganic pigments, etc. are dispersed in a binder in order to prevent stains on a recording head during recording. Further, aliphatic acids and metal soaps are added in order to improve a releasing property with respect to the head. Accordingly, the heat-sensitive recording materials are generally produced by applying pigments, waxes and additives etc. to a support base in addition to the color former and the color developer which directly contribute color formation.

For example, as the pigments, there are kaolin, calcined kaolin, talc, agalmatolite, diatom earth, calcium carbonate, aluminium hydroxide, magnesium hydroxide, magnesium carbonate, titanium oxide, barium carbonate, urea-formaldehyde filler and cellulose filler, etc. As the waxes, there are paraffin wax, carnauba wax, microcrystalline wax, polyethylene wax and higher aliphatic acid esters, etc.

Useful metal soaps include polyvalent metal salts of higher aliphatic acids, such as zinc stearate, aluminium stearate, calcium stearate and zinc oleate.

All of the components are applied after being dispersed in a binder. Water soluble binders are generally used. Examples of such binders include polyvinyl alcohol, hydroxyethyl cellulose, hydroxypropyl cellulose, ethylene-maleic acid anhydride copolymer, styrene-malic acid anhydride copolymer, isobutylene-maleic acid anhydride copolymer, polyacrylic acid, polyacrylamide, starch derivatives, casein and gelatine, etc. In order to give a water resisting property to these binders, it is possible to add water-proofing agents (gelling agents and cross-linking agents) or hydrophobic polymer emulsions such as a styrene-butadiene rubber latex or an acrylic resin emulsion, etc.

The coating solution is most generally applied to a base paper.

Generally, the amount of coating is 2 to 10 g/m$^2$, preferably 4 to 8 g/m$^2$, as the solid content (dry weight). The lower limit is determined by the concentration in thermal color formation and the upper limit is determined chiefly by economic restrictions.

The amount of the naphthol derivative used in the present invention is 0.1 to 4.0 g/m$^2$, preferably 0.2 to 2.0 g/m$^2$, and more preferably 0.3 to 1.5 g/m$^2$. The urea derivative and/or urethane derivative are applied in the same ranges of amount as in the naphthol derivative. Further, the electron donating colorless dye is used in an amount of 0.1 to 2.0 g/m$^2$, preferably 0.2 to 1.0 g/m$^2$ and the electron accepting compound is used in an amount of 0.1 to 4.0 g/m$^2$, preferably 0.5 to 2.0 g/m$^2$.

The following is a detailed description of a specific example which was prepared. However, the present invention is not restricted to this example.

EXAMPLE

(1) Production of Samples 1 to 7

5 g of the electron donating colorless dye, 2-anilino-3-chloro-6-diethylaminofluoran was dispersed in 50 g of a 5% aqueous solution of polyvinyl alcohol (saponification value: 99%, degree of polymerization: 1000) by processing in a ball mill for 24 hours. On the other hand, 10 g of the electron accepting compound, bisphenol A, was dispersed in 100 g of a 5% aqueous solution of polyvinyl alcohol by processing in a ball mill for 24 hours. Further, 10 g each of the urea derivative, the urethane derivative and the naphthol derivative shown in Table 1 were dispersed respectively in 100 g of a 5% aqueous solution of polyvinyl alcohol by processing in a ball mill for 24 hours. After these four dispersions were blended, 20 g of kaolin (Georgia kaolin) was added thereto and thoroughly disperse. Further, 5 g of a 50% dispersion of paraffin wax emulsion (Cellosol #428, produced by Chukyo Yushi Co.) was added thereto to produce a coating solution.

The coating solution was applied to a base paper having an areal weight of 50 g/m$^2$ so as to result in a solid content of 6 g/m$^2$. After being dried at 60° C. for 1 minute, it was subjected to supercalendering under a linear pressure of 60 kgW/cm to obtain a coated paper.

The coated paper was subjected to thermal color formation by a facsimile receiving set (Type EF-22, made by Matsushita Denso Co., Ltd.) under a heat energy of 35 mJ/mm$^2$, and the color density was measured.

The results are shown in Table 1.

(2) Production of Comparative Samples 1 to 2

The same examination was carried out using the same composition as in Samples 1 to 5, except that only one of the urea derivatives, urethane derivatives and naphthol derivatives was used.

The results are shown in Table 1.

It is understood from Table 1 that the sensitivity of the recording materials according to the present invention is clearly higher.

Further, when the fog density in Table 1 is beyond 0.13, the merchandise value markedly deteriorates.

The results in Table 1 clearly show that the electron accepting compound of the present invention produces remarkably excellent heat-sensitive recording sheets.

It clearly appears as though the inclusion of an urea derivative and/or an urethane derivative as well as a naphthol derivative in making a coating for a heat sensitive material makes it possible to achieve the object of the present invention.

TABLE 1

| Sample No. | Urea Derivative or Urethane Derivative | Naphthol Derivative | Color Density (35 mJ/mm$^2$) | Fog Density |
|---|---|---|---|---|
| 1 | N—Octadecyl-urea | 2-p-Chlorobenzyl-oxynaphthalene | 1.18 | 0.06 |
| 2 | N—Hexadecyl-urea | 2-p-Chlorobenzyl-oxynaphthalene | 1.18 | 0.06 |
| 3 | N—Octadecyl-urea | 2-Benzyloxy-naphthalene | 1.20 | 0.07 |
| 4 | N,N'—didodecyl-urea | 2-Benzyloxy-naphthalene | 1.15 | 0.06 |
| 5 | Phenylcarbamoyl-oxydodecane | 2-Benzyloxy-naphthalene | 1.19 | 0.09 |
| 6 | N—Octadecyl-urea | 2-Phenoxyacetyl-oxynaphthalene | 1.19 | 0.07 |
| 7 | Phenylcarbamoyl-oxydodecane | 2-Phenoxyacetyl-oxynaphthalene | 1.18 | 0.09 |
| Comparative Example 1 | N—Octadecyl-urea | — | 0.52 | 0.06 |
| Comparative Example 2 | — | 2-Benzyloxy-naphthalene | 1.00 | 0.06 |

The above results clearly show that greater color density can be obtained when a naphthol derivative and an urea derivative and/or an urethane derivative in the present invention is used. Furthermore, the results also show the increased color density is not accompanied by an undesirable increase in fog density.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material, comprising a substrate coated with:

an electron donating colorless dye;

an electron accepting compound;

a naphthol derivative represented by the general formula (V)

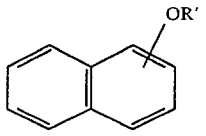

(V)

wherein R′ represents an alkyl group, an aralkylene group, an aryl group, an alkylcarbonyl group, an arylcarbonyl group, an aryloxyalkylcarbonyl group, an alkylsulfonyl group or an arylsulfonyl group; and at least one compound selected from the group consisting of urea derivatives containing 7 or more carbon atoms and a urethane derivatives containing 8 or more carbon atoms.

2. A heat-sensitive recording material as claimed in claim 1, wherein the urea derivative is represented by the general formula (I):

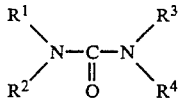

(I)

wherein $R^1$, $R^2$, $R^3$ and $R^4$ independently represent a hydrogen atom, a substituted or unsubstituted alkyl group or a substituted or unsubstituted aryl group and $R^4$ represents

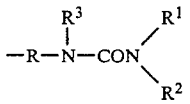

wherein R is an alkylene group, an arylene group, an aralkylene group or an oxyalkylene group, and $R^1$, $R^2$ and $R^3$ are the same as in the above formula (I).

3. A heat-sensitive recording material as claimed in claim 1, wherein the urethane derivative is represented by a general formulae selected from the following group of general formulae (II), (III) and (IV):

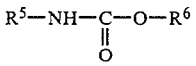

(II)

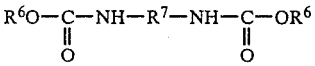

(III)

-continued

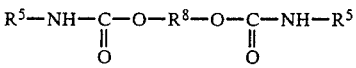

(IV)

wherein $R^5$ and $R^6$ each represent a substituted or unsubstituted alkyl group or a substituted or unsubstituted aryl group, $R^7$ represents an alkylene group, an arylene group, an aralkylene group or an oxyalkylene group, and $R^8$ represents an alkylene group or an oxyalkylene group.

4. A heat-sensitive recording material as claimed in claim 1, wherein the urea derivative and urethane derivative have a melting point in the range of from 40° C. to 200° C.

5. A heat-sensitive recording material as claimed in claim 4, wherein the urea derivative and the urethane derivative have a melting point in the range of from 70° C. to 150° C.

6. A heat-sensitive recording material as claimed in claim 1, wherein R′ represents an alkyl group containing 4 to 20 carbon atoms, an aralkyl group containing 7 to 24 carbon atoms, an alkylcarbonyl group containing 2 to 20 carbon atoms or an arylcarbonyl group containing 7 to 20 carbon atoms.

7. A heat-sensitive recording material as claimed in claim 1, wherein the naphthol derivative has a melting point in the range of from 40° C. to 150° C.

8. A heat-sensitive recording material as claimed in claim 7, wherein the naphthol derivative has a melting point in the range of from 50° C. to 120° C.

9. A heat-sensitive recording material as claimed in claim 1, wherein the weight ratio of the electron donating colorless dye to the electron accepting compound is in a range of from 1:10 to 1:1.

10. A heat-sensitive recording material as claimed in claim 9, wherein the weight ratio of the electron donating colorless dye to the electron accepting compound is in the range of 1:5 to 2:3.

11. A heat-sensitive recording material as claimed in claim 1, wherein at least one compound selected from a urea derivative and a urethane derivative is present in a weight ratio of 20% to 300% with respect to the electron accepting compound.

12. A heat-sensitive recording material as claimed in claim 11, wherein the weight ratio is in the range of 50% to 150%.

13. A heat-sensitive recording material as claimed in claim 1, wherein the naphthol derivative is present in a weight ratio of 20% to 300% with respect to the electron accepting compound.

14. A heat-sensitive recording material as claimed in claim 13, wherein the naphthol derivative is present in a weight ratio of from 40% to 150% with respect to the electron accepting compound.

15. A heat sensitive recording material as claimed in claim 1, wherein the compound is a urea derivative.

16. A heat sensitive recording material as claimed in claim 15, wherein the urea derivative is represented by the general formula (I):

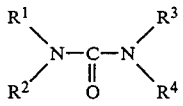

(I)

wherein $R^1$, $R^2$, $R^3$ and $R^4$ independently represent a hydrogen atom, a substituted or unsubstituted alkyl group or a substituted or unsubstituted aryl group and $R^4$ represents

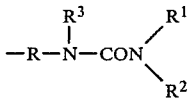

wherein R is an alkylene group, an arylene group, an aralkylene group or an oxyalkylene group, and $R^1$, $R^2$ and $R^3$ are the same as in the above formula (I).

17. A heat sensitive recording material as claimed in claim 1, wherein the compound is a urethane derivative.

18. A heat-sensitive recording material as claimed in claim 17, wherein the urethane derivative is represented by a general formula selected from the following group of general formulae (II), (III) and (IV):

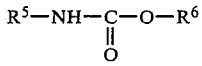

(II)

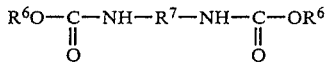

(III)

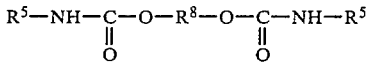

(IV)

wherein $R^5$ and $R^6$ each represent a substituted or unsubstituted alkyl group or a substituted or unsubstituted aryl group, $R^7$ represents an alkylene group, an arylene group, an aralkylene group or an oxyalkylene group, and $R^8$ represents an alkylene group or an oxyalkylene group.

* * * * *